US005323944A

United States Patent [19]

Faust et al.

[11] Patent Number: 5,323,944

[45] Date of Patent: Jun. 28, 1994

[54] ARRANGEMENT FOR THE LATERAL POSITIONING OF A RECORDING MEDIUM IN A PRINTER OR PHOTOCOPIER

[75] Inventors: Martin Faust, Fahrenzhausen-Kammerberg; Rudolf Waechtler, Hohenpolding; Walter Kopp, Taufkirchen; Edmund Creutzmann, Markt Schwaben, all of Fed. Rep. of Germany

[73] Assignee: Siemens Nixdorf Informationssysteme AG, Fed. Rep. of Germany

[21] Appl. No.: 917,081

[22] PCT Filed: Dec. 4, 1990

[86] PCT No.: PCT/EP90/02093

§ 371 Date: Aug. 3, 1992

§ 102(e) Date: Aug. 3, 1992

[87] PCT Pub. No.: WO91/11381

PCT Pub. Date: Aug. 8, 1991

[30] Foreign Application Priority Data

Feb. 2, 1990 [XH] Hague ..... 90102128.7

[51] Int. Cl.[5] ..... B65H 25/26

[52] U.S. Cl. ..... 226/15; 226/45; 226/181; 250/561

[58] Field of Search ..... 226/15, 18, 21, 45, 226/181; 250/561

[56] References Cited

U.S. PATENT DOCUMENTS

| | | | |
|---|---|---|---|
| 4,147,922 | 4/1979 | Naeser et al. | 219/216 |
| 4,331,274 | 5/1982 | Halewijn et al. | 226/15 |
| 4,485,982 | 12/1984 | St. John et al. | 242/57.1 |
| 4,961,704 | 10/1990 | Nemoto et al. | 432/8 |

FOREIGN PATENT DOCUMENTS

| | | |
|---|---|---|
| 0031137 | 7/1981 | European Pat. Off. . |
| 3814596 | 11/1988 | Fed. Rep. of Germany . |
| 3729982 | 3/1989 | Fed. Rep. of Germany . |

OTHER PUBLICATIONS

Japanese Abstract #61,84672, vol. 10, No. 256 (P-493) (2312) Apr. 1986, "Heat Roller Fixing Device".

Japanese Abstract #63-154565, vol. 12, No. 419 (M-760) (3266) Jun. 1988, "Edge Control Device".

IBM Technical Disclosure Bulletin, vol. 23, No. 7A Dec. 1980, "Page Edge Sensor", R. J. Perkins.

*Primary Examiner*—Lenard A. Footland
*Assistant Examiner*—Paul T. Bowen
*Attorney, Agent, or Firm*—Hill, Steadman & Simpson

[57] ABSTRACT

An arrangement for the lateral positioning of a recording medium (100) in a printer or photocopier comprises a scanning arrangement (S) for establishing the ACTUAL position of the recording medium and a motor-drivable roll arrangement consisting of a counter-roll (201) and a pressure roll (205) which can be pivoted onto and away from the counter-roll (201), between which rolls the recording medium is guided. Furthermore, an apparatus (E) is provided for the controllable adjusting of the pressing force at the feed roll (205) on the counter-roll (201) along its roll length, and a control arrangement (P) which registers the ACTUAL position of the recording medium (100) via the scanning arrangement (S) and adjusts the pressing force of the feed roll (205) via the said apparatus (E) as a function of a predeterminable REFERENCE position. The arrangement is used preferably in the fuser station of an electro-photographic printer for the controllable lateral positioning of the recording medium (100).

13 Claims, 8 Drawing Sheets

QUOTIENT MEMBER
120
UA
UD
US
118
INTEGRAT-OR
INTEGRAT-OR
118
V2
V1
119
SUMMAT-ION
SUB-TRACTOR
117
PEAK MEASURING INSTRUMENT
SLS
SRS
116
116
PEAK MEASURING INSTRUMENT
115
HIGH PASS FILTER
HIGH PASS FILTER
115
SL
SR
SUMMATION
114
114
114
114
CURRENT TO VOLTAGE CONVERTERS
PHOTO ELEMENT
103
103
104
104

12V
UD
0V
118
116
OP4
C
R
DB
OP3
SLS
SRS
117
OP2
115
Q
SL
SR
OP1
114
122
103
104

ARRANGEMENT FOR THE LATERAL POSITIONING OF A RECORDING MEDIUM IN A PRINTER OR PHOTOCOPIER

BACKGROUND OF THE INVENTION

1. Field of the Invention

The invention relates to an arrangement for the lateral positioning of a recording medium in a printer or photocopier, preferably an arrangement for the positioning of endless paper in the fuser, or fixer, station of an electrophotographic printer.

2. Description of the Related Art

It is customary to use endless paper with transportation perforations in high speed non-mechanical printing apparatuses which operate by the electrophotographic or magnetic principle. In this case, the endless paper is withdrawn from a stack, transported through a transfer station with the aid of tractors engaging in the edge perforations and thereby coated with a layer of toner depending on the characters to be printed. The layer of toner situated on the recording medium is then thermally fused in a fuser station. A fuser station of this type is known, for example, from U.S. Pat. No. 4,147,922. For this purpose, the fuser station comprises in a customary manner an electric, heated fuser roller and a feed roller which can be pivoted onto and away from the fuser roller. In this case, the recording medium must be guided precisely through the fuser station without movement relative to the fuser roller. As s result of the design, the fuser station is arranged at a relatively large spacing from the transfer station and the paper tractors situated there which guide and transport the web of paper. There is thus the risk of the web of paper migrating horizontally in the fuser station during the printing operation. This can lead to tensioning of the web of paper and, with high transport speeds, to a tear in the paper.

Additionally, non-mechanical printing apparatuses must be designed in such a way that they can process webs of recording media of different widths. With these, it is necessary to design the fuser station with the rollers arranged therein in accordance with the greatest width of recording medium. Regions of the fuser roller or of the feed roller in the fuser station which do not come into contact with the recording medium heat up locally more intensely than the actual contact regions with the recording medium because the recording medium withdraws heat from the fuser roller in the fusing region during the fusing operation. This leads to a heat-dependent different diameter of the feed roller which generally consists of elastic material. As a result, the recording medium is deflected horizontally.

It has therefore proved necessary to monitor the lateral position of the recording medium precisely when it enters the fuser station in order to be able to intervene, if necessary, in the control of the fuser.

However, the problem of precise controllable guidance of recording media is present not only in electrophotographic printers and photocopiers. Even with other printing apparatuses which operate, for example, with inking units, it is necessary to position the recording medium precisely, at least in the printing region.

For positioning the recording media in printing apparatuses, it is customary to use electrically adjustable mechanical guide elements in the paper duct of the printing apparatus, the scanning of the ACTUAL position of the recording media likewise taking place via mechanical contact elements.

For scanning the position of the recording media, it is known from the IBM Technical Disclosure Bulletin, Vol. 23, No. 7a, December 1980 and from European Patent 0 031 137 to use optoelectronic scanning apparatuses.

A further problem consists in the scanning of the ACTUAL position of the recording media with the aid of such optoelectronic scanning apparatuses. In modern electrophotographic and magnetic printers, different recording medium materials can be used regardless of the scope of application. These recording media can consist, for example, of strongly reflecting white paper or a film with a metallized surface or even of transparent plastic film. In all these cases, it is difficult due to the different transparency of the materials used to scan the edge of the recording medium or its transportation perforations using an optoelectronic scanner.

SUMMARY OF THE INVENTION

The object of the invention is to provide an optoelectronic scanning apparatus, with which recording media exhibiting different optical scanning response and made of different materials with scanning elements arranged thereon can be scanned reliably.

If recording media with transportation perforations are used, scanning of the transportation perforations or other scanning elements situated on the recording medium is to be possible using the scanning apparatus.

A further aim of the invention is to provide an arrangement for the lateral positioning of a recording medium in a printer or photocopier, with which it is possible to position the recording medium precisely in its lateral position. In this case, the use of adjustable guide elements for the recording medium is to be largely dispensed with.

This object is achieved by an arrangement for scanning a recording medium provided with scanning elements, having a) an optoelectronic scanning apparatus with a light source for providing a scanning light for the scanning elements and a plurality of sensor surfaces for receiving the scanning light modulated by the scanning elements and for producing electric sensor signals as a function of the modulated scanning light received from a scanning region of defined scanning length and scanning width, a1) at least one left and one right sensor surface being arranged opposite one another along a dividing line;

a2) the dividing line being assigned to a direction of movement of the scanning elements;

a3) the scanning length being shorter than the interval between the scanning elements;

b) an evaluation arrangement with a comparison apparatus and a filter apparatus which registers the sensor signals of the left and right sensor surfaces during the movement of the recording medium and, by comparing the sensor signals, generates a measurement signal which is dependent on the movement and the position of the scanning elements, the filter apparatus suppressing constant measured-value proportions of the sensor signals so that only the measured-value proportions which can be assigned to the movement of the scanning elements are evaluated by the evaluation arrangement.

Advantageous embodiments of the invention are found in an arrangement as set out above wherein the filter apparatus consists of an electric high pass filter. Preferably, a comparison apparatus with a subtraction member for forming a relative position signal assigned to the difference between the sensor signals is provided. In addition, a quotient member subsequent to the comparison apparatus for forming an absolute position signal from the quotient of the relative position signal and a summation signal formed by summation of the sensor signals via a summation member may be provided. The scanning apparatus preferably has an optical imaging apparatus which images the illuminating scanning region of the recording medium onto the sensor surfaces. The scanning elements are formed by recesses in the recording medium, and the recording medium is guided between the light source and the sensor surfaces of the scanning apparatus.

The evaluation arrangement has circuit elements for producing a variable-voltage measurement signal, a maximum voltage level of the measurement signal being assigned to the width of the scanning region and a corresponding relative proportion of the maximum voltage level being assigned to the position of the scanning elements in the scanning region.

An arrangement for establishing an ACTUAL position of the recording medium and a motor-drivable roller arrangement consisting of a counter-roller and a feed roller which can be pivoted onto and away from the counter-roller, between which rollers the recording medium is guided;

an apparatus for the controllable adjusting of the pressing force of the feed roller on the counter-roller along its roller length;

a control arrangement which registers the ACTUAL position of the recording medium via the scanning arrangement and adjusts the pressing force of the feed roll via the said apparatus as a function of a predeterminable reference position.

This arrangement is defined by an eccentric apparatus having two cams, which engage on lateral bearing elements of the feed roll, can be driven by electric motor and have control cams for pressing the feed roll onto the counter-roll as a function of the course of the control cams and the rotary position of the cams. Preferably, a guide bar is provided which is arranged in the manner of a balance beam with spacing parallel to the feed roll and so as to be pivotable about an axis of rotation relative to the feed roll, and spring elements are provided which are coupled to the guide bar and the bearing elements of the feed roll and are arranged on both sides of the axis of rotation of the guide bar, and a guide apparatus which is coupled to the guide bar in order to deflect the guide bar via corresponding elements about the axis of rotation into predeterminable deflection positions and thus to adjust the pressing force of the feed roll on the counter-roll along its roll length is provided as well.

In a preferred embodiment, rotatably mounted links are coupled to the spring elements, having swivel arms for pressing the feed roll onto the counter-roll. In addition, eccentric elements which are arranged on the links, are rotatable via a drive apparatus, and are supported on the bearing elements of the feed roll for pivoting the feed roll onto and away from the counter-roll, a limiting stop which is arranged in a stationary manner in the pivoting range of the links and is designed to be adjustable as required for absorbing the spring force of spring elements during the pivoting-on and pivoting-away, and a restoring spring coupled to the bearing elements of the feed roll for resting the bearing elements on the eccentric elements are provided.

This arrangement is used in a fuser station of an electrophotographic printing apparatus, the counter-roll being constructed as fuser roll of the fuser station.

The arrangement according to the invention allows precise lateral positioning of a recording medium, whether it is a web-type recording medium or single sheets, without the use of separately adjustable paper guide elements.

For this purpose, a transport apparatus for the recording medium, consisting of a counter-roller and a feed roller which can be pivoted onto and away from the counter-roller, is provided which has an apparatus for the controllable adjustment of the pressing force of the feed roll onto the counter-roll along its roll lengths. The ACTUAL position of the recording medium is scanned with the aid of a scanning arrangement in the direction of movement of the recording medium before the roller arrangement and, with the aid of a control arrangement, the pressing force of the feed roller is then adjusted via the adjusting apparatus as a function of a predeterminable REFERENCE position. The recording medium can thus be positioned precisely.

It is particular advantageous to use the arrangement in an electrophotographic printing apparatus for controlling the position of the recording medium in a thermal fuser station.

In a further advantageous embodiment of the invention, an eccentric apparatus is used for adjusting the pressing force and has two cams which engage on lateral bearing elements of the feed roller, can be rotated by an electric motor and have control cams for pressing the feed roller onto the counter-roller as a function of the course of the control cams and the rotary position of the cams. In this case, the cams can be coupled to individually adjustable adjusting motors, or they are connected to one another via an axle and driven by a single motor.

For compensating the pressing force on the counter-roller, in a further advantageous embodiment of the invention a guide bar in the manner of a balance beam can be provided, which is arranged spaced from and parallel to the feed roller and so as to be pivotable about an axis of rotation relative to the feed roller. For adjusting the pressing force of the feed roller onto the counter roller along its roller length, the guide bar is coupled to an adjusting motor which deflects the guide bar about the axis of rotation into predeterminable defection positions and thus positions the recording medium laterally between the counter-roller and the feed roller.

BRIEF DESCRIPTION OF THE DRAWINGS

Embodiments of the invention are illustrated in the drawings and described in detail below by way of example.

DETAILED DESCRIPTION OF THE PREFERRED EMBODIMENTS

Figure 1:
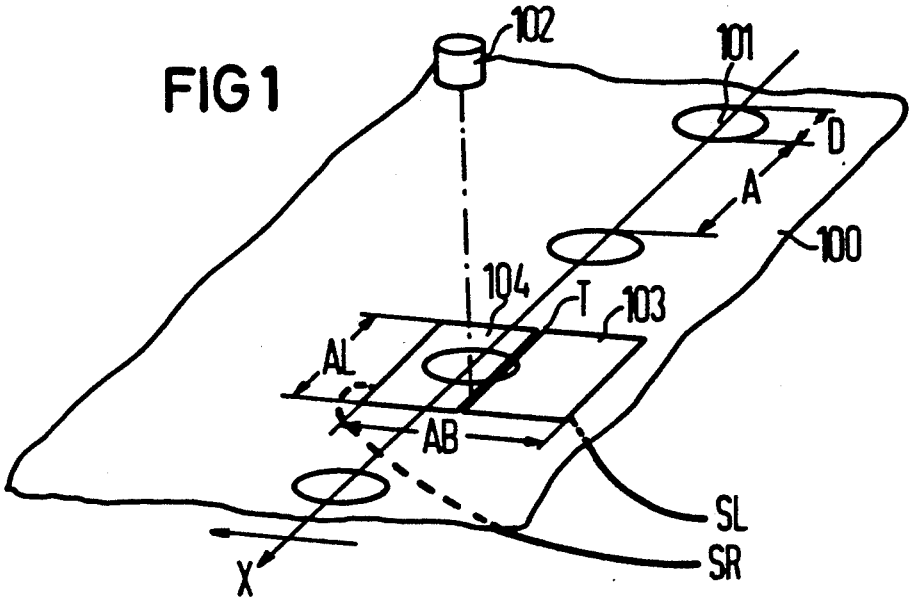
FIG. 1 shows a diagrammatic illustration of the scanning apparatus used in the arrangement as a transmitted light scanner.
Figure 3:
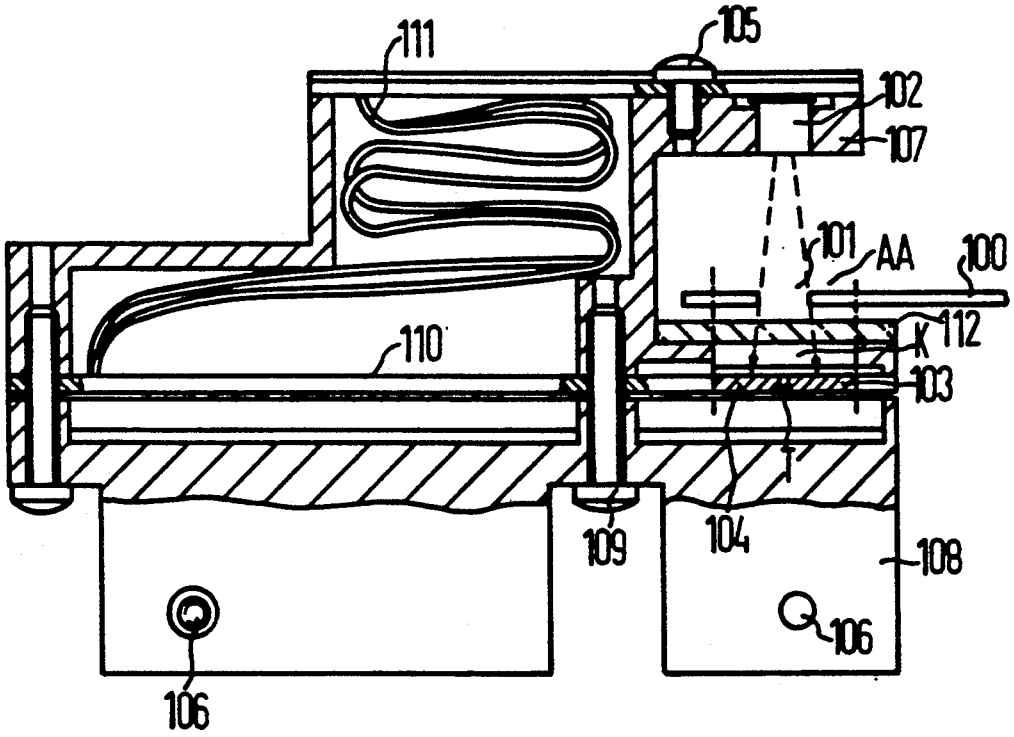
FIG. 3 shows a diagrammatic sectional illustration of the scanning apparatus used in the arrangement for scanning the edge perforations in a recording medium.

In an electrophotographic printing apparatus, an optoelectronic scanning apparatus illustrated in FIGS. 1 and 3 is arranged between the transfer station and fuser station. The scanning apparatus serves for registering the position and the movement of a recording medium 100 (endless paper) via its transportation perforations 101. The recording medium customarily is a folded endless paper with transportation perforations 101 which are arranged in the edge region of the endless paper and via which the endless paper is transported in a customary manner within the printing apparatus. For this purpose, printing apparatuses generally have so-called paper tractors with transportation pins which engage in the transportation perforations 101. In this case, the diameter D of the transportation perforations 101 and their interval A on the recording medium 100 are standardized. The optoelectronic scanning apparatus comprises a light source 102 in the form of an LED and two sensor surfaces 103 and 104 for generating electric output signals as a function of the illumination intensity. In this case, the left sensor surface 103, seen in the direction X of movement of the recording medium 100, supplies an electric sensor signal SL and the right sensor surface 104 supplies an electric sensor signal SR. The two sensor surfaces can each consist of a single photoelement, or they can be composed of a multitude of interconnected photoelements. Left and right sensor surfaces 103 and 104 are arranged opposite one another along a dividing line T, the dividing line T running along the direction X of movement of the recording medium 100 or the transportation perforations 101 to be scanned.

As illustrated in FIG. 3, the light source 102 and sensor surfaces are arranged in a holder 105 which can be fastened via fastening openings 106 in the printing apparatus. In this case, the holder 105 consists of a top part 107 for receiving the light source 102 in the form of an LED and a bottom part 108 with the fastening openings 106 as described. Fastened with the aid of fastening screws 109 between the top and bottom parts is a printed circuit board 110, on whose front part are arranged the sensor surfaces 103 and 104. On its rear part are elements of the evaluation arrangement described later for the sensor signals. The printed circuit board is coupled via leads 111 to corresponding electric connections of the printing apparatus.

In order to be able to scan the edge region of the recording medium 100 with the transportation perforations 101, the top part 107 of the holder 105 is of U-shaped construction. In this case it surrounds the edge region of the recording medium 100. To protect the sensor surfaces 103 and 104, a glass plate 112 is situated above the sensor surfaces.

The optoelectronic sensor fastened in the holder 105 is adjusted in the printing apparatus in such a way that, in normal operation, the transportation perforations 101 are guided centrally over the dividing line T. If in accordance with the illustration of FIG. 3 a transportation hole is situated centrally above the sensor surfaces 103 and 104, the transportation hole 101 acts as an aperture and a light circle K is produced on the sensor surfaces 102 and 103. Due to the geometrical arrangement of the scanning apparatus and its construction, a scanning region AA results on the recording medium 100 with a scanning width AB and a scanning length AL (FIG. 1), which region is determined in this case by the overall width of the sensor surfaces and their length. In order to ensure that only one transportation hole 101 is scanned in each case during the scanning operation, the length AL of the scanning region is selected to be shorter than the interval A between the transportation perforations 101.

Figure 2:
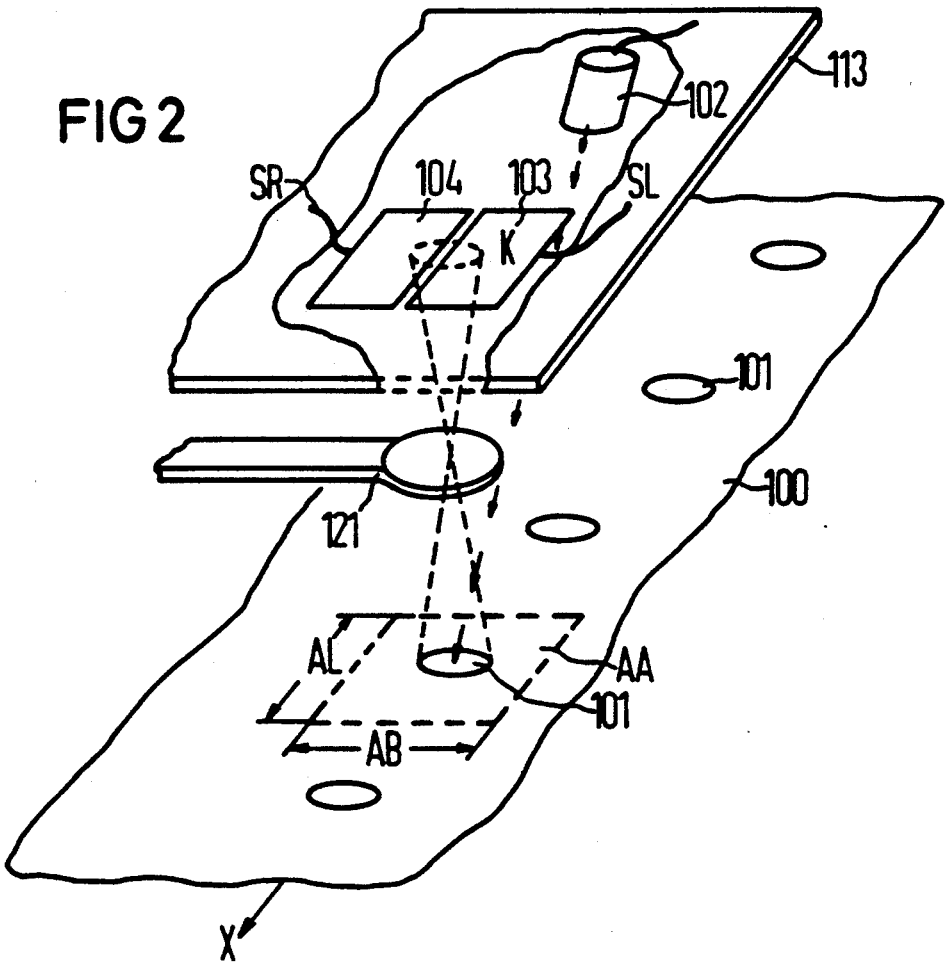
FIG. 2 shows a diagrammatic illustration of the scanning apparatus used in the arrangement as a directlight scanner.

If the construction of the printing apparatus does not allow a transmitted light scanner in accordance with FIG. 3 to be used, the optoelectronic scanning apparatus can also be constructed as a direct-light scanner in accordance with FIG. 2. In this case, the sensor surfaces 103 and 104 are arranged together with the light source 102 in a holder 113 above the recording medium 100 to be scanned. In this case, the light source 102 homogeneously illuminates the scanning region AA with its scanning width AB and its scanning length AL, which region is projected onto the sensor surfaces 103 and 104 with the aid of an optical apparatus, for example a lens 121. In this case, the illuminated transportation hole 101 is likewise imaged on the sensor surfaces 103 and 104. Since the light falling in the scanning region AA is reflected more weakly in the region of the transportation perforation 101, the transportation hole 101 appears on the sensor surfaces 103 and 104 as a dark circle. The sensor signals SL, SR produced during scanning with a direct-light scanner in accordance with FIG. 2 are inverted in their signal course relative to the sensor signals SL and SR with a transmitted light scanner with a construction in accordance with FIG. 3.

The evaluation arrangement described below for evaluating the sensor signals is designed for processing sensor signals of a transmitted light scanner in accordance with FIG. 3. If sensor signals of a direct-light scanner in accordance with FIG. 2 are to be scanned using such an evaluation arrangement, it may be necessary to invert the sensor signals via appropriate known electrical components.

Figure 4:
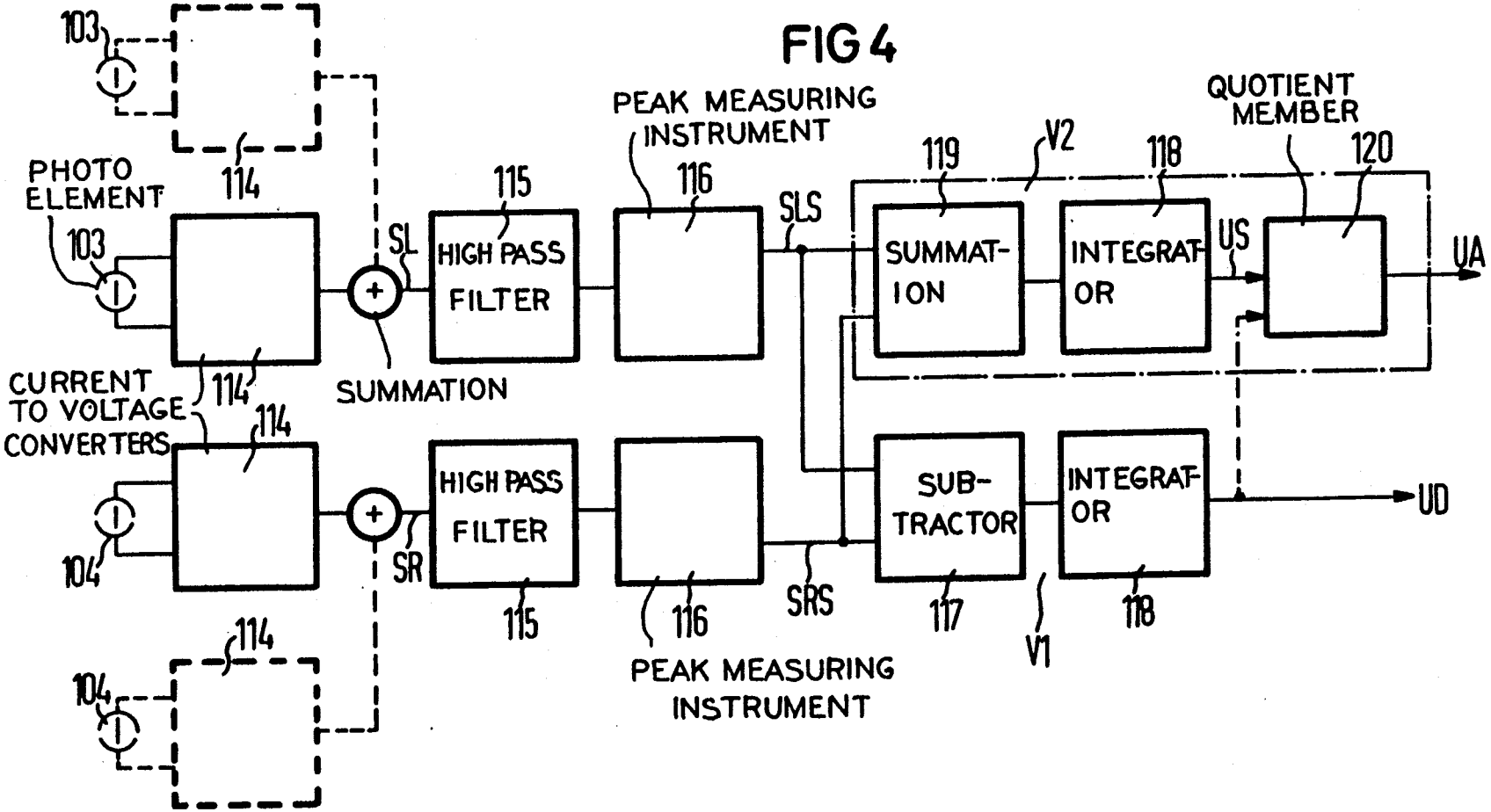
FIG. 4 shows a diagrammatic block circuit diagram of the evaluation arrangement for evaluating the sensor signals supplied by sensor surfaces of the scanning apparatus.

The electrical arrangement illustrated in a block circuit diagram in FIG. 4 for evaluating the sensor signals comprises current-to-voltage converters 114 which are coupled to the photoelements 103, 104 of the sensor surfaces and convert the photoconductive current depending on the illumination intensity into a voltage. In this case, such a current-to-voltage converter can be assigned to each individual photoelement of the sensor surfaces. In the examplary embodiment illustrated, each sensor surface consists of one photoelement. Thus only one current-to-voltage converter 114 is coupled in each case to each sensor surface. However, in accordance with the dashed illustration, a plurality of photoelements can also be interconnected to form a common sensor surface. The outputs of the converters 114 are then joined together via summation elements. Connected downstream of the current-to-voltage converters 114 is a filter apparatus in the form of a high pass 115 which serves for suppressing the constant measured-value proportions of the left and right sensor signals. The arrangement thus registers only the dynamic measured-value proportions of the sensor signals. This is of great advantage for the evaluation. When scanning the recording medium 100 using a scanning arrangement in accordance with FIG. 3, it can occur that the recording medium 100 is guided so far out of the scanning region of the scanner that parts, for example, of the right sensor surface are exposed and thus scanning light falls on the sensor surface further to the right. The exposed sensor surface produces an additional sensor signal, in addition to the sensor signal produced by the transportation perforation 101. The resultant overall sensor signal is thus falsified and can no longer be assigned unambiguously to the transportation perforation 101.

Similar interferences falsifying the measurement signal can occur if the edge is torn or if the scanning elements used are not the transportation perforations of the recording medium but, for example, specifically applied recesses at the edge of the recording medium.

If a scanning apparatus in accordance with FIG. 2 is used, scanning elements on the recording medium which consist of bar-type prints or the like can also be scanned using this apparatus. These prints are generally arranged at the edge of the recording medium so that the edge of the recording medium is guided within the scanning region. The scanning region thus also covers a region which does not belong to the recording medium and falsifies the sensor signal in the manner described.

Connected downstream of the high pass 115 is a peak measurement instrument 116. The latter determines the maximum value of the sensor signal during the scanning of the transportation hole and thus the measured value belonging to the hole center. Furthermore, it calculates a mean over a number of transportation holes during a scanning cycle. This scanning apparatus thus becomes insensitive to interferences due to frayed or concealed transportation holes.

If partially transparent recording media, such as, for example, films, are used in the printing apparatus, the high pass 115 ensures suppression of the static measured-value proportions and thus suppression of the sensor-signal proportion produced by light penetrating the recording medium. The peak measuring instrument allows accurate registration of the measured value belonging to the center of the transportation perforation, even with partially transparent material.

The evaluation arrangement has a comparison apparatus V1, V2 to form a position signal from the left and right signals SLS and SRS processed via the high pass 115 and the peak measuring instrument 116. This comparison apparatus consists in the simplest case V1 of a subtractor 117 with a downstream integrator 118. The comparison apparatus forms an output signal UD, whose voltage level is a function of the difference between the processed left SL and right SR sensor signals. The signal UD is a measure of the position of the transportation hole in relation to the center point of the scanning region of the scanner. This relative position signal generated via the comparison apparatus V1 is sufficient in most applications.

A further comparison apparatus V2 can be arranged for forming a position signal UA assigned to the absolute position of the scanning element 101. This comparison apparatus comprises a summator 119 with a downstream integrator 118 and a quotient member 120. The position signal US, formed by the integrator connected to the output of the summator 119, is a voltage signal which is dependent on the sum of the processing sensor signals SL and SR. The movement of the perforated recording medium can be determined from the signal US. Furthermore, it is possible to use the summated signal US to standardize the deviation in position. The position signal UA, which can then be picked off at the output of the quotient member 120, is a measure of the absolute position of the transportation hole 101 in the scanning region AA. This absolute position signal UA corresponds to the quotient from the differential signal UD and the summated signal $$US, \left(UA = \frac{UD}{US}\right).$$

Figure 5:
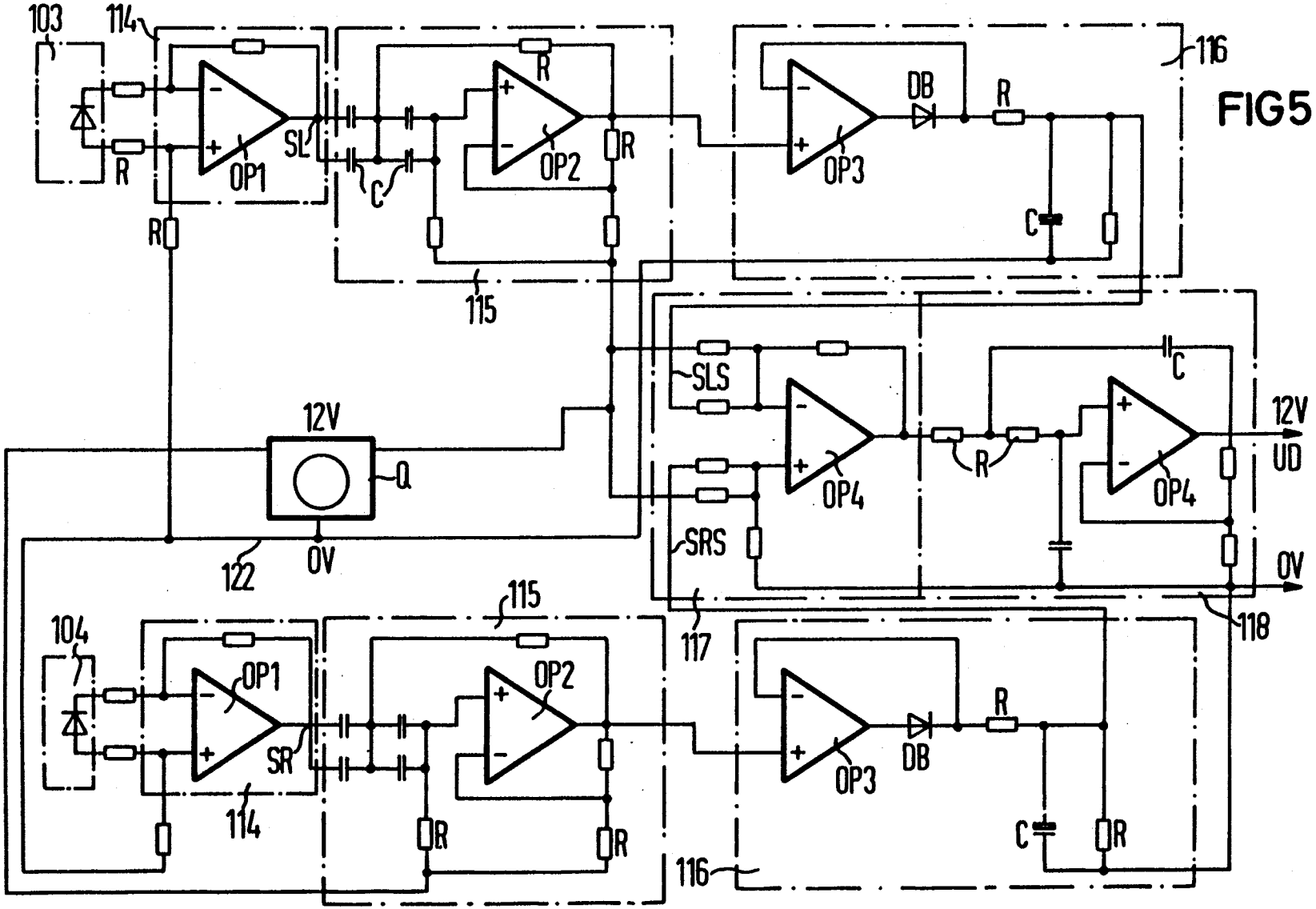
FIG. 5 shows a detailed circuit diagram of the evaluation arrangement illustrated in FIG. 4.

The construction of the evaluation arrangement is illustrated in detail in FIG. 5. The two photoelements 102 and 104 consist of customary photodiodes. The photoelectric current, which is dependent on the illumination and flows through the diodes, is converted in the current-to-voltage converters via operational amplifiers OP1 with associated resistors R into position signals SL and SR in the form of a voltage. The high passes 115 with operational amplifiers OP2, resistors R and capacitors C suppress the static proportions of the sensor signals SL and SR. Connected to the high passes 115 are the peak measuring instruments 116 consisting of operational amplifiers OP3 with associated limiter diodes DB and smoothing elements consisting of resistors R and capacitors C.

Coupled to the outputs of the peak measuring instruments 116 is a subtractor 117 with an operational amplifier OP4 arranged therein with associated resistors R, which subtractor forms a differential signal from the output signal SLS of the peak measuring instrument 116 of the left sensor surface and the output signal SRS of the peak measuring instrument 116 of the right sensor surface, which differential signal is amplified in the integrator 118 with the operational amplifier OP4 and appropriate networks consisting of resistors R and capacitors C. A measurement signal UD can be picked off at the output of the integrator 118, the voltage level of which measurement signal corresponds to the relevant position of the scanning elements in the scanning region AA. A voltage source Q is provided for the voltage supply of the evaluation arrangement.

A voltage range of 12V is assigned to the scanning width AB of the scanning region AA via the integrator 118 in conjunction with the subtractor 117. Every voltage below 12V defines a position of the scanning elements along the scanning width AB. The position signal UD can thus be processed particularly easily with the aid of the control apparatus of the printer.

The relation between the position of the transportation perforation 101 in the scanning region AA (X-axis) and the position signal UD (Y-axis) can be seen in FIG.

Figure 6:
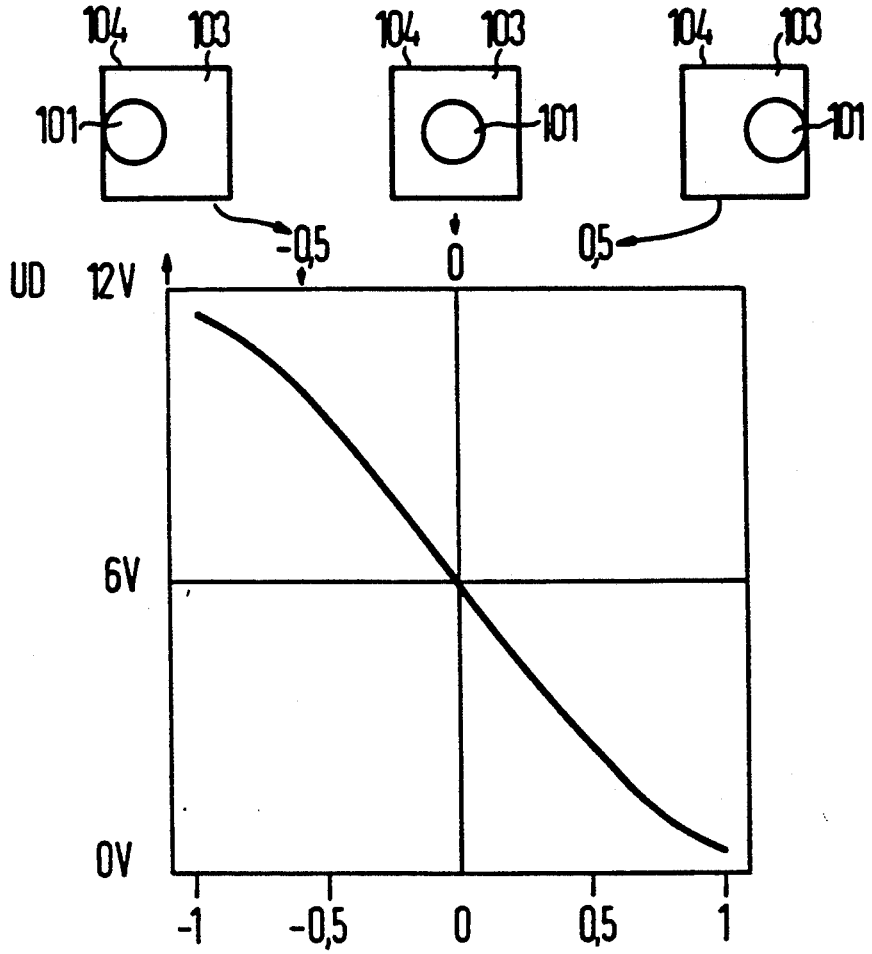
FIG. 6 shows a diagrammatic illustration of the course of the measurement signal at the output of the arrangement as a function of the hole position in the scanning region.

6. The deviation of the center point of the transportation perforation 101 from the central line of the scanning region AA (corresponding to the course of the dividing line T) is indicated in units of the diameter D of the transportation perforation 101 along the X-axis 2. The associated position of the transportation perforation 101 in the scanning region AA is illustrated diagrammatically above the diagram of FIG. 6. If the transportation perforation 101 is situated centrally in the scanning region AA above the dividing line T, there is a resultant position signal UD of 6 Volts. If the position signal UD has a level greater than 6 Volts, the transportation hole is situated in the region of the right sensor surface 104 and, if the level is less than 6 Volts, the transportation hole is situated in the region of the left sensor surface 103.

Figure 7:
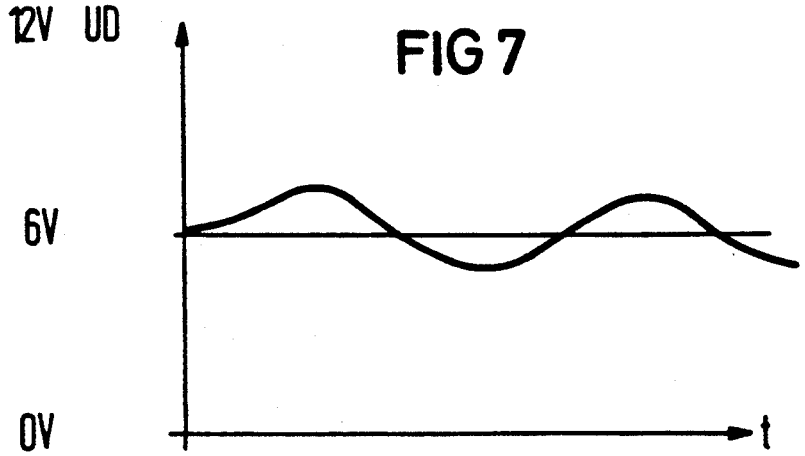
FIG. 7 shows a diagrammatic illustration of the course of the measurement signal over time during the scanning operation.

If the course of the position signal UD (Y-axis) is plotted over time t (X-axis) in accordance with FIG. 7 during the scanning of the recording medium, the signal course visible in FIG. 7 results in normal operation. The position signal UD fluctuates around the voltage level of 6 Volts assigned to the central position of the scanning region.

A printing apparatus operating by the principle of electrophotography comprises a fuser station for fusing a toner image on a recording medium in the form of an endless web of paper 100. In this case, the recording medium 100 is subjected to heat and pressure in the fuser station and a firm bonding of the toner image with the recording medium is thus achieved. For thermal fusing, the fuser station comprises a fuser roll or 201 with a heat radiator 202 arranged therein in the form of a halogen lamp. The fuser roller 201 is mounted on a frame 203 of the printer and is driven via a motor 204. The fuser roller 201 usually consists of a plastic-coated aluminum tube. A feed roller 205 made of a steel tube sheathed in rubber is mounted so that it can be pivoted onto and away from the fuser roller 201. The feed roller 205 is mounted on two lateral bearing elements 206. The bearing elements 206 are mounted in the frame 203 of the printer so as to be pivotable about a stationary axis of rotation 207. Arranged for pivoting the feed roller 205 onto and away from the fuser roller 201 acting as counter-roller are two cam disks 209 which can be rotated via an electric motor 208 (FIG. 9) and rest on guide attachments 210 of the bearing elements 206. Two tension springs 211 engaging laterally on the bearing elements 206 serve as restoring springs for bearing elements 206 and press the bearing elements 206 against the cam disks 209 via the guide attachments 210. The cam disks 209 are mounted on level-type links 212 with an axis of rotation 213 assigned to the frame 203 of the printing apparatus. Arranged with spacing parallel to the feed roller is a guide bar 214 which is approximately as long as the feed roller. It is mounted pivotably in a bearing piece 215 approximately central relative to the feed roller, specifically about an axis 216 running approximately perpendicular to the longitudinal extent of the feed roller. The guide bar 214 has at its ends adjustable attachment elements (adjusting screws) 217, in which springs 218 connected to the links 212 are suspended. In conjunction with the centrally mounted guide bar 214, the springs 218 form a type of balance beam for force compensation of the pressing force of the feed roll 205 on the fuser roller 201 over the length of the feed roller. Adjustable stops 219 for the cam disks 209 are arranged in the bearing region for limiting the swivel range of the links 212. The motor 208 is coupled to the cam disks via a cross-coupling 220. It allows pivoting of the cam disks 209 about the axis of rotation 213 corresponding to the direction of the arrow illustrated in FIG 9 and, thus, movement relative to the motor 208 attached in a stationary manner via attachment elements (screws etc.) 221 to the frame 203 of the printing apparatus.

The spring force of the springs 218 is considerably greater than the spring force of the restoring springs 211 on the feed roller 205. In the pressed-on state (FIG. 8) of the feed roller 205, the links 212 are pivoted away from the stops 219. In accordance with their deflection, cam disks 209 press the feed roller 205 against the fuser roller 201. In this case, the pressing force is determined essentially by the spring force of the springs 218 in conjunction with the geometrical construction of the link 212 and the degree of deflection of the cam disks 209.

For pivoting away, the cam disks 209 are rotated back via the motor 208. As a result, firstly the link 212 moves under the effect of the spring force 218 without the feed roller 205 being pivoted away from the fuser roller 201, specifically until the links 212 rest with their lower pivot arms on the stops 219. As a result, the spring force of the spring elements 218 is absorbed. On further rotation of the cam disks 219 for pivoting the feed roller 205 away completely, the feed roller 205 is then raised from the fuser roller 201 under the effect of the restoring spring 211. In this actual pivoting-away operation, the bearing elements 206 rest via their attachments 210 on the cam disks 209. The pivoting-away range and thus the range of rotation of the cam disks 209 is limited by an attachment 222 on the cam disks which, with a complete revolution of the cam disks 209, rests on the guide attachments 210 of the bearing elements during pivoting-away. The feed roller 205 is thus in the pivoted-away state and the recording medium 200 can be threaded into the fuser station. The pivoting of the feed roller 205 onto the fuser roller 201 takes place in the opposite direction. In this case, the feed roller 205 is firstly brought to rest on the fuser roller 201 by rotation of the cam disks 209, specifically counter to the spring force of the restoring springs 211. On further rotation of the cam disks 209, the links 212 are raised from the stops 219 and the spring force of the springs 218 is fully effective. The balance beam-type construction of the pressing mechanism for the feed roller 205 with the guide bar 214 and spring elements 218 in conjunction with the links 212 ensures a force compensation of the pressing force of the feed roll 205 along the fuser roller 201 and thus an even fusing force on the recording medium 200. This is important for an even fusing result, especially when recording media 100 of different widths are used.

Figure 8:
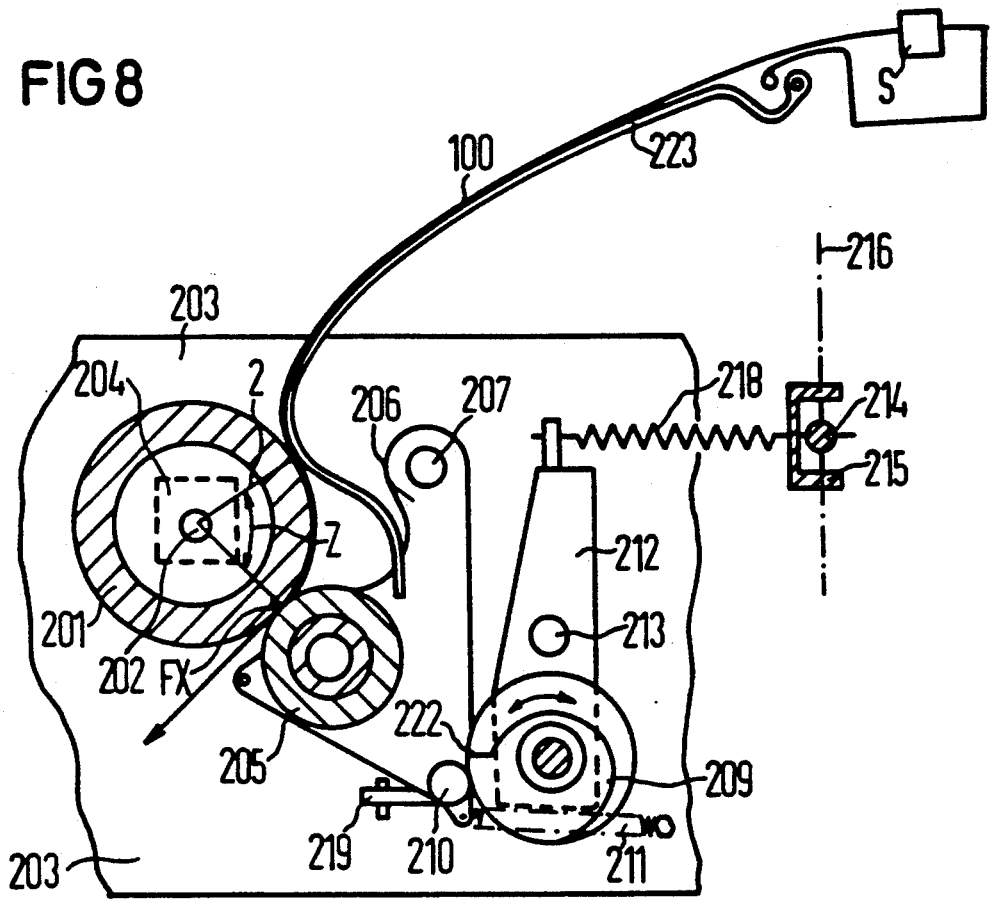
FIG. 8 shows a diagrammatic sectional illustration of a fuser station of an electro-photographic printing apparatus.

As already detailed at the beginning, the fuser station in the electrophotographic printing apparatus serves for fusing the toner image applied to the recording medium in a transfer station onto the recording medium 100 by heat and pressure. For this purpose, the recording medium 100 corresponding to FIG. 8 is brought to rest on the fuser roller 201 with its toner-layer side at the top via a fusing saddle 223 which can be pivoted on and away. It is wrapped around the fuser roller 201 at a wrapping angle Z and is heated up there (pre-heated). The actual fusing then takes place in a fusing gap FX, namely the pressing region between the fuser roller 201 and the feed roller 205. For fusing, the recording medium 100 has to be heated in the fusing region consisting of the wrapping angles Z and the fusing gap FX from room temperature to a fusing temperature of greater than 110° C. To achieve a good printing quality, it is therefore necessary to guide the recording medium 100 precisely in the fuser station.

It is customary to use recording media of different widths or different formats in electrophotographic printers or photocopiers. In order to be able to guarantee a continuous printing operation, the individual assemblies of the printing apparatus must be designed in such a way that switching over between various paper formats or various recording media widths is possible without prolonged cooling phases. For this reason, the fuser roller 201 and the feed roller 205 are designed in terms of their length for the widest possible recording media format. If a recording medium having a width which is less than the maximum possible recording media width is fused between the fuser roller 201 and the feed roller 205, the feed roller 205 is heated locally to a different degree. In the region of the recording medium, the heating is less than in the region of the feed roller 205 not covered by the recording medium since the recording medium absorbs and discharges heat during the fusing operation.

It has now been established that the different heating of the regions of the feed roller in recording media of different widths leads to a different expansion of the feed roller. This results in a different diameter of the feed roller 205 in the region of the recording medium and in the region not covered by the recording medium. This leads, in turn, to the recording medium being deflected horizontally in the fusing gap FX. Smearing of the toner image and thus disturbances in the printed image are the result.

Furthermore, a lateral deflection of this type of the recording medium leads to tensioning of the recording medium in the paper guides of the printing apparatuses. In this case, tearing of the paper can be the result.

It is therefore favorable to control the horizontal position of the recording medium 100 in the fusing gap FX during the fusing operation, specifically especially when recording media of different widths are used. In this case, the positioning itself takes place by changing the pressing force of the feed roller 205 onto the fuser roller 201 over the length thereof.

A prerequisite for the control is firstly the registration of the ACTUAL POSITION of the recording medium on entry of the recording medium 100 into the fuser station in the inlet region of the fusing saddle 223. Arranged there for this purpose is an optoelectronic sensor S which registers the lateral position of the recording medium 100 via its transportation holes. In this case, the sensor S can be designed in accordance with the scanning arrangement of FIG. 1. However, other sensors can also be used, for example mechanical scanning elements or the like.

Figure 9:
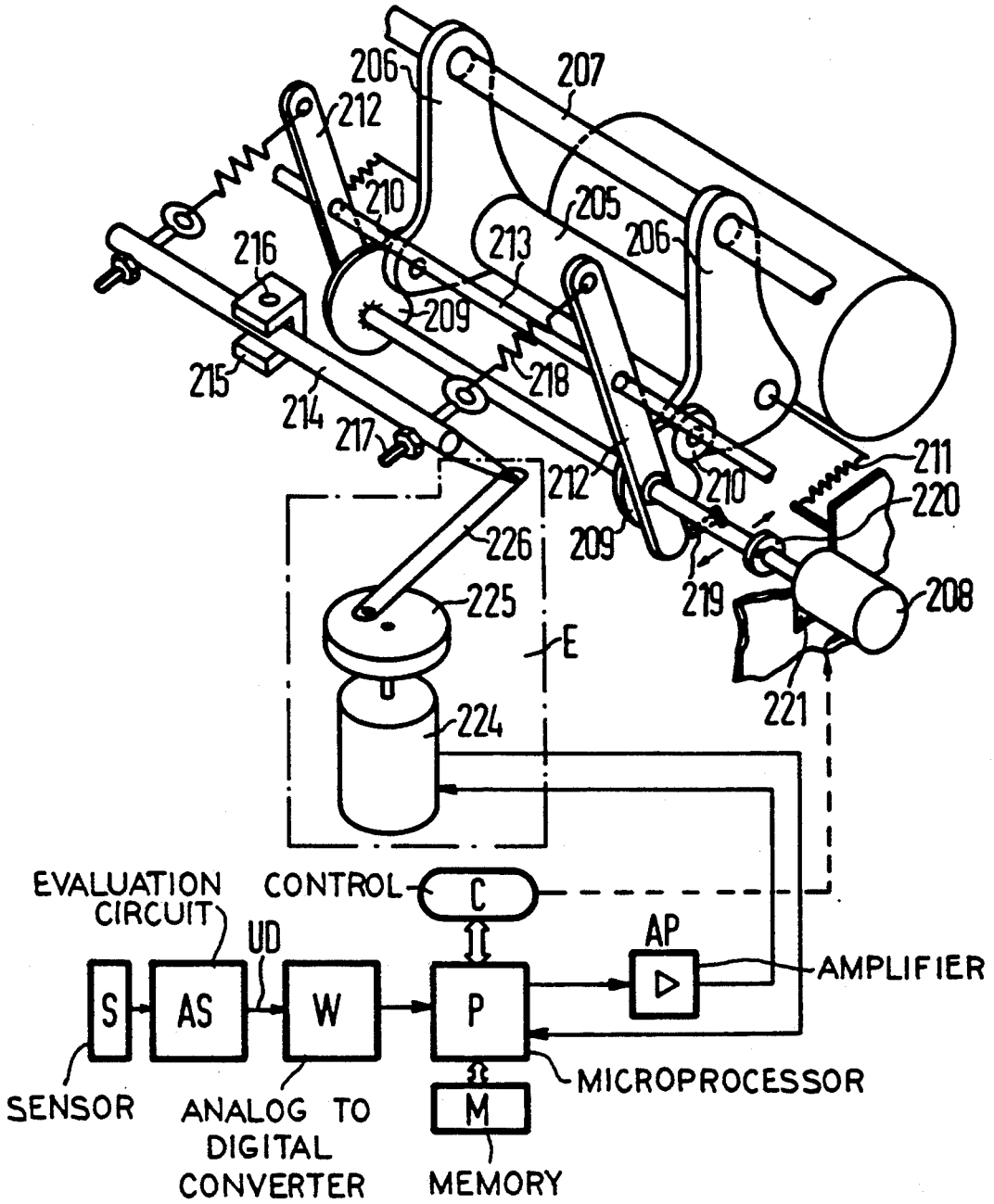
FIG. 9 show a diagrammatic illustration of the fuser station of FIG. 8 with a block circuit diagram of the control arrangement for the lateral positioning of the recording medium.

The arrangement illustrated in FIG. 9 for the lateral positioning of the web-type recording medium 100 comprises a sensor S with an associated evaluation circuit AS which can be designed in accordance with the sensor and the evaluation arrangement of FIGS. 1 to 7. Arranged downstream of the evaluation circuit AS is an analog-to-digital converter W which converts the position signals UD, supplied by the evaluation arrangement AS, into a digital signal so that the latter can be evaluated and processed with the aid of a microprocessor P. The microprocessor P is connected via a data bus to the actual control C of the printing apparatus. This control (equipment control) can be constructed, for example, in accordance with U.S. Pat. No. 4,593,407; a commercially available microprocessor (e.g. Siemens 8080 microprocessor) lends itself for use as microprocessor P. Additionally, microprocessor P is connected to a program memory M for receiving the control program.

The adjusting signals, supplied by the microprocessor P, are amplified via an amplifier AP and fed to an adjusting arrangement E for adjusting the pressing force of the feed roller 205 onto the fuser roller 201 along the fuser roller.

This arrangement for adjusting the pressing force E can be constructed in various ways: in the exemplary embodiment of FIG. 9 having a fusing apparatus with a balance beam-type force compensating apparatus, the apparatus E comprises an adjusting motor 224 with an eccentric disk 225 arranged thereon. The eccentric disk 225 is connected to the guide bar 214 of the fuser station via a linkage 226. By rotating the eccentric disk 225, the guide bar 214 is deflected to a varying extent around the axis of rotation 216 via the linkage 226 and thus the pressing force on the bearing elements 206 of the feed roller 205 is changed. The horizontal position of the recording medium can thus be adjusted in the fusing gap FX.

This adjustment takes place via the arrangement described for the lateral positioning by means of the microprocessor P which compares the ACTUAL position signals UD, supplied by the sensor S, with a reference position stored, for example, in the memory M and, as a function thereof, drives the adjusting motor 224 via the amplifier AP. The position of the adjusting motor 224, which can be registered, for example, via a scanning apparatus, is likewise fed to the microprocessor P for evaluation.

The position of the recording medium in the fuser station can be optimized via the control arrangement. In this case, the aim of control can be the so-called zero position of the endless paper, i.e. the positioning of the transportation perforations of the endless paper on a position assigned to the position above the dividing line T of the sensor surfaces of the scanner. However, the aim of control can also be a lead of the recording medium if, for example, initially very narrow paper is printed and then a change to wide paper is envisaged. In this case, the control arrangement takes into consideration the behavior of the recording medium to be expected in the future and deflects the recording medium at a given time before or after changeover. The different behavior of the recording media and any necessary lead can be stored as a program within the scope of the memory M of the microprocessor arrangement.

Figure 10:
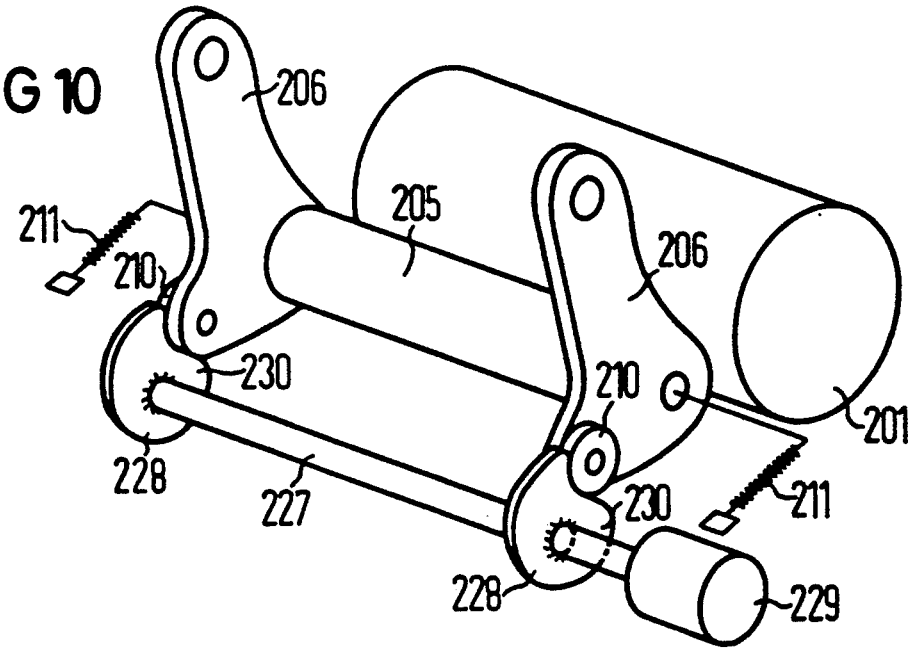
FIG. 10 shows a diagrammatic illustration of an apparatus for the controllable adjustment of the pressing force of the feed roller on the counter-roll.

A further embodiment of the apparatus for adjusting the pressing force E can be seen in FIG. 10. The fusing apparatus illustrated there corresponds in its construction in principle to the arrangement of FIG. 8, but it does not have a force compensating apparatus for the pressing force of the feed roller 205.

Two cam disks 228 arranged on an axle 227 are provided for adjusting the pressing force over the length of the feed roller 205. In a first embodiment shown in FIG. 10, the two cam disks 228 are connected rigidly via the axle 227 and are connected to an adjusting motor 229. The cam disks 228 have differently shaped control cams 230 which interact with the attachments 210 of the bearing elements 206. Resulting therefrom and depending on the rotary position of the adjusting motor 229 and thus of the cam disk are a different pressing behavior and thus different pressing forces on the bearing elements 206 as a result of the differently formed control cams 230.

Figure 11:
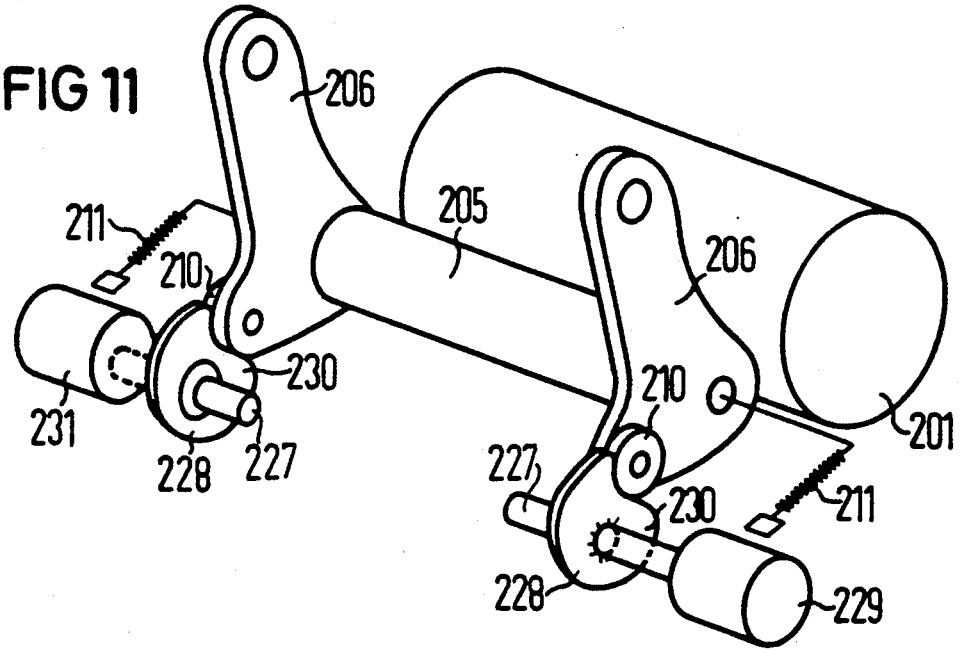
FIG. 11 is an illustration of another embodiment similar to that shown in FIG. 10.

In a further embodiment of the adjusting arrangement shown in FIG. 11, the cam disks 228 are mounted on the axle 227 so as to be movable independently of one another and are each connected to the adjusting motor 229 and a further adjusting motor 231. Via the adjusting motors 231 and 229 and as a function of the drive signals of the microprocessor P of the control arrangement, the pressing force on the bearing elements 206 can be set as a function of the rotary position of the cam disks 228. In this case, the control cams 230 of the cam disks 228 can be designed in accordance with the required pivot stroke of the bearing elements 206 and the desired pressure force of the feed roller 205 on the fuser roller 201. The axle 227 guiding the cam disks 228 is arranged in a stationary manner between frame elements 203 of the printing apparatus. However, the cam disks 228 can also have separate bearing axles.

Although other modifications and changes may be suggested by those skilled in the art, it is the intention of the inventors to embody within the patent warranted hereon all changes and modifications as reasonably and properly come within the scope of their contribution to the art.

We claim:

1. An arrangement for scanning a recording medium provided with scanning elements, having a) an optoelectronic scanning apparatus with a light source for providing a scanning light for the scanning elements and a plurality of sensor surfaces for receiving the scanning light modulated by the scanning elements and for producing electric sensor signals as a function of the modulated scanning light received from a scanning region of defined scanning length and scanning width, a1) at least one left and one right sensor surface being arranged opposite one another along a dividing line;

a2) the dividing line being assigned to a direction of movement of the scanning elements;

a3) the scanning length being shorter than the interval between the scanning elements;

b) an evaluation arrangement with a comparison apparatus and a filter apparatus which registers the sensor signals of the left and right sensor surfaces during the movement of the recording medium and, by comparing the sensor signals, generates a measurement signal which is dependent on the movement and the position of the scanning elements, the filter apparatus suppressing constant measured-value proportions of the sensor signals so that only the measured-value proportions which can be assigned to the movement of the scanning elements are evaluated by the evaluation arrangement.

2. The arrangement as claimed in claim 1, wherein the filter apparatus consists of an electric high pass filter.

3. The arrangement as claimed in claim 2, defined by a comparison apparatus with a subtraction member for forming a relative position signal assigned to the difference between the sensor signals.

4. The arrangement as claimed in claim 3, defined by a quotient member subsequent to the comparison apparatus for forming an absolute position signal from the quotient of the relative position signal and a summation signal formed by summation of the sensor signals via a summation member.

5. The arrangement as claimed in claim 2, wherein the scanning apparatus has an optical imaging apparatus which images the illuminating scanning region of the recording medium onto the sensor surfaces.

6. The arrangement as claimed in claim 2, wherein the scanning elements are formed by recesses in the recording medium, and the recording medium is guided between the light source and the sensor surfaces of the scanning apparatus.

7. The arrangement as claimed in claim 1, wherein the evaluation arrangement has circuit elements for producing a variable-voltage measurement signal, a maximum voltage level of the measurement signal being assigned to the width of the scanning region and a corresponding relative proportion of the maximum voltage level being assigned to the position of the scanning elements in the scanning region.

8. An arrangement as claimed in claim 1 for establishing an ACTUAL position of the recording medium and a motor-drivable roller arrangement consisting of a counter-roller and a feed roller which can be pivoted onto and away from the counter-roller, between which rollers the recording medium is guided;

an apparatus for the controllable adjusting of the pressing force of the feed roller on the counter-roller along its roller length;

a control arrangement which registers the ACTUAL position of the recording medium via the scanning arrangement and adjusts the pressing force of the feed roller via the said apparatus as a function of a predeterminable reference position.

9. The arrangement as claimed in claim 8, defined by an eccentric apparatus having two cams, which engage on lateral bearing elements of the feed roller, can be driven by electric motor and have control cams for pressing the feed roller onto the counter-roller as a function of the course of the control cams and the rotary position of the cams.

10. The arrangement as claimed in claim 8, defined by a guide bar which is arranged in the manner of a balance beam with spacing parallel to the feed roller and so as to be pivotable about an axis of rotation relative to the feed roller, and spring elements which are coupled to the guide bar and the bearing elements of the feed roller and are arranged on both sides of the axis of rotation of the guide bar, and a guide apparatus which is coupled to the guide bar in order to deflect the guide bar via corresponding elements about the axis of rotation into predeterminable deflection positions and thus to adjust the pressing force of the feed roller on the counter-roller along its roller length.

11. The arrangement as claimed in claim 10, defined by rotatably mounted links, coupled to the spring elements, having swivel arms for pressing the feed roller onto the counter-roller.

12. The arrangement as claimed in claim 11, defined by eccentric elements which are arranged on the links, are rotatable via a drive apparatus, and are supported on the bearing elements of the feed roller for pivoting the feed roller onto an away from the counter-roller, a limiting stop which is arranged in a stationary manner in the pivoting range of the links and is designed to be adjustable as required for absorbing the spring force of spring elements during the pivoting-on and pivoting-away and a restoring spring coupled to the bearing elements of the feed roller for resting the bearing elements on the eccentric elements.

13. The arrangement as claimed in claim 8, wherein the arrangement is used in a fuser station of an electrophotographic printing apparatus, the counter-roller being constructed as fuser roller of the fuser station.

* * * * *